United States Patent [19]

Antunez

[11] Patent Number: 4,841,579

[45] Date of Patent: Jun. 27, 1989

[54] FLUSH VALVE WITH SNAP-ON FLAPPER

[76] Inventor: Bruce A. Antunez, 1143 Indian Springs Dr., Glendora, Calif. 91740

[21] Appl. No.: 123,444

[22] Filed: Nov. 20, 1987

[51] Int. Cl.[4] ..... E03D 1/35

[52] U.S. Cl. ..... 4/393; 4/395

[58] Field of Search ..... 4/378, 392, 393, 395, 4/390, 391, 402–404

[56] References Cited

U.S. PATENT DOCUMENTS

| | | | |
|---|---|---|---|
| 1,712,605 | 5/1929 | Delany | 4/403 |
| 2,741,775 | 4/1956 | Schmidt | 4/393 |
| 2,810,915 | 10/1957 | Zinkil | 4/393 |
| 2,849,725 | 9/1958 | Armstrong et al. | 4/410 |
| 3,267,491 | 8/1966 | Snyder et al. | 4/391 |
| 3,325,828 | 6/1967 | Alexander | 4/402 X |
| 3,368,224 | 2/1968 | Ament | 4/393 |
| 4,365,365 | 12/1982 | Antunez | 4/392 X |

*Primary Examiner*—Charles E. Phillips
*Attorney, Agent, or Firm*—Donald D. Mon

[57] ABSTRACT

A rigid flapper type valve having a backing plate has been provided with a valve seal in the form of a flexible disc mounted to the bottom of the flapper valve. During sealing the disc will flex to contact the backing plate. A vent hole is provided in the backing plate to vent the area between the disc and plate.

3 Claims, 2 Drawing Sheets

FLUSH VALVE WITH SNAP-ON FLAPPER

FIELD OF THE INVENTION

This invention relates to flush valves for toilet tanks of the type having a flapper which when lifted enables a flushing volume of water to escape from the tank.

BACKGROUND OF THE INVENTION

The flapper-type toilet tank valve is one of the best known and most widely used valves in the world. It is installed in a tank where it holds back a volume of water sufficient when released to flush a commode or a urinal. The water is admitted to the tank by another valve, often called a tank valve or a ballcock valve, which refills the tank after the flush valve is closed, to complete a flushing cycle.

The flush valve is usually installed in an outlet port in the bottom of the tank, along with a standpipe that discharges into the outlet port downstream from the tank valve itself.

The tank valve includes a valve seat which surrounds an outlet passage that discharges to the outlet port. A flapper is pivotally mounted to fixed structure, usually the standpipe, and carries a valve seal that bears against the valve seat to close the valve in a lowered position, and which is movable up and away from the seat to open the valve. A lift chain is usually provided to lift the flapper and open the valve. The chain is connected through a linkage to a handle actuated by the user.

A frequently-encountered mounting means for attachment for the flapper is a pair of diametrically extending posts on the standpipe, and each of these posts has an upwardly extending ear spaced from the standpipe. This arrangement is particularly useful when the entire flapper is made of rubber, and is in a single piece. Then apertured arms of the resilient flapper are twisted to get them over the ears and relaxed to surround the posts which act as a pivot for the arms. This is a device which has sold by the millions for many years, and in many applications is completely reliable for long periods of time. It is readily molded and very affordable.

However, in recent years the water in some tanks to which the rubber flappers are subjected has attacked the rubber of which an affordable single piece cast flapper valve can be made. There are some rubber compounds that can resist this attack, but they are relatively costly. Affordable organic plastic materials that can resist this attack are rigid, and if provided as a single piece valve cannot be attached to the conventional mounting means because they cannot be twisted, and also because the ears prevent the arms from being sprung over the posts. Thus, when a resilient rubber flapper valve that is fitted to the described posts fails, the flapper must either be replaced with another that is likely to suffer a similar fate, or the entire assembly of threaded base, valve seat, standpipe, and some other kind of mounting means must be replaced. An inexpensive, more chemically-resistant flapper cannot merely be substituted for the failed resilient flapper.

It is an object of this invention to provide a flapper with a rigid construction that can be made of suitably chemically-resistant material and which can be installed on a conventional post-and-ear mounting at an agreeable and competitive cost.

However, affordable rigid materials cannot themselves make a suitable fluid seal with the customary rigid seats on flush valves. Accordingly, a suitably deformable and resilient material must be provided for this purpose. Such materials must resist chemical attack and are relatively costly. They should be minimized. Molded shapes adhered to rigid structure, while useful, involve still more cost and complexity.

An optimal seal would be a simple flexible disc adapted both by its flexural and deformable properties to making a good fluid seal. It could affordably be made of a minimal quantity of costlier chemically resistant material. However, a surprising result sometimes occurs. When such a disc, bound to and surrounding a central post a backed up by a flat backing disc, seals on a hard seat, after a brief period of time the valve begins to leak. This is a perplexing event because one can readily theorize that the disc should merely flex and deform to fit to the valve seat.

Efforts to overcome this surprising leakage while still using a flat disk for a seal have shown that unbalanced forces seem to develop unless the region between the backing plate and the valve seal is equalized with the tank pressure. The reasons are not fully understood, but the result is that a optimum valve can be made, and the perplexing leakage does not occur.

BRIEF DESCRIPTION OF THE INVENTION

A flapper according to this invention has a pair of arms, each adapted to snap laterally edgewise onto a respective mounting post. Each mounting post has an ear that resists sideward removal of the arm from the posts. The mounting post is on or is part of a standpipe. The flapper arms are rigid and carry a rigid backing plate that backs an annular deformable seal. The seal bears against a valve seat when the flush valve is closed.

Attachment means on the arms comprises a socket on each arm open at an edge of the respective arm, with an entry clearance that forms a snap-over interference with the post, and a wider region to receive the arm without interference after the arm has passed the snap-over interference so the flapper is readily pivotable on the posts.

In one embodiment, the seal is contiguous to the backing plate. It relies for its sealing properties on its deformability to make a good line seal. For this purpose, a relatively expensive very flexible material must be used, usually cemented or molded onto the backing plate.

According to a preferred but optional feature of the invention, the valve seal is a flexible disc mounted to a central post and spaced from the backing plate. Upon contact with the valve seat, it will be deflected and deformed. It will make a ring contact, with an open annular region between the valve seal and the backing plate, limited inwardly by the post and outwardly by the seal formed by contact between the back side of the valve seal and the backing plate. A vent port opens into this region through the backing plate, fluidly interconnecting this region and the pressure in the tank on the other side of the backing plate. Thus fluids such as water or air cannot be trapped in this region by the seal formed between the backing plate and the valve seal. A reliable closure with the valve seal is made, using only a flat, stamped out disc of suitable material. This expensive material is minimized and the simple disc construction can readily be removed and replaced if necessary.

The above and other features of this invention will be fully understood from the following detailed description and the accompanying drawings, in which:

DETAILED DESCRIPTION OF THE INVENTION

Figure 1:
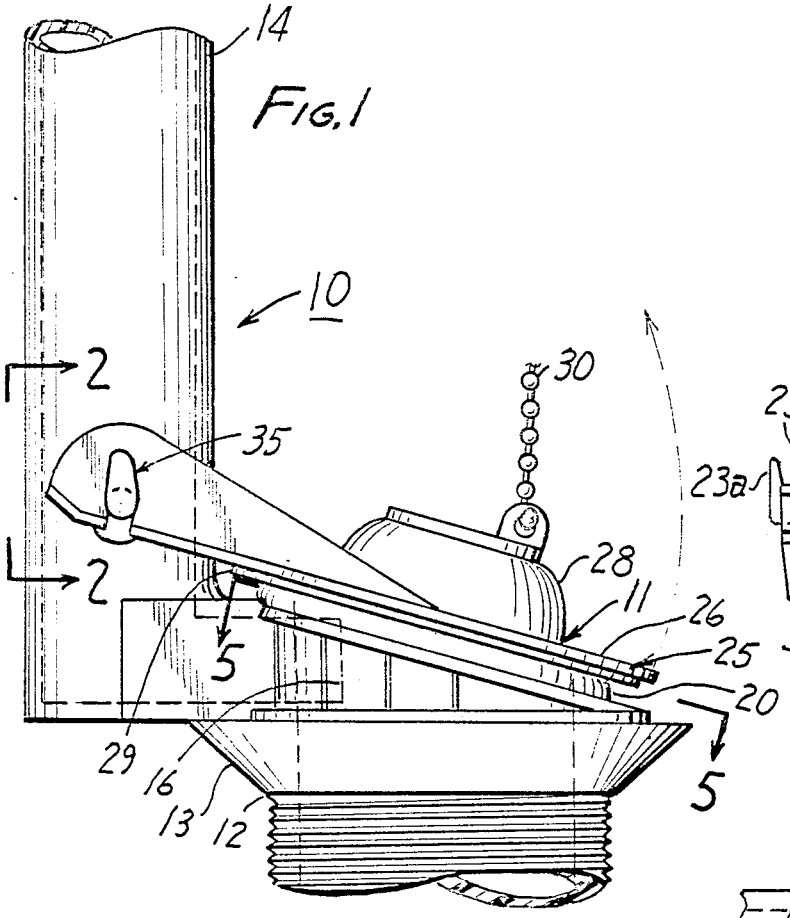
FIG. 1 is a side view of the presently-preferred embodiment of the invention.
Figure 2:
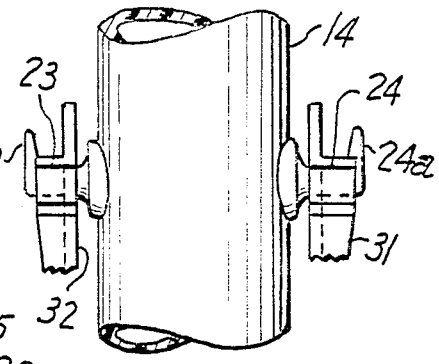
FIG. 2 is a fragmentary side view taken at line 2—2 in FIG. 1.
Figure 5:
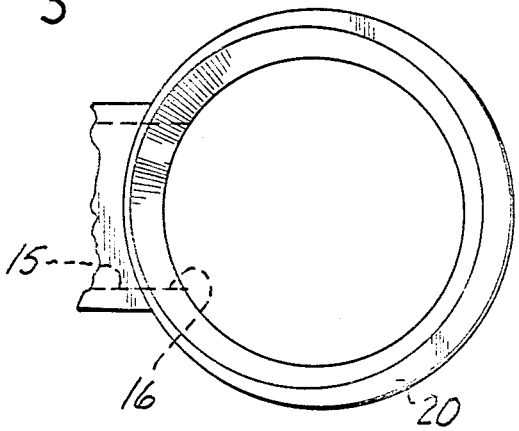
FIG. 5 is a cross-section taken at line 5—5 in FIG. 1.
Figure 3:
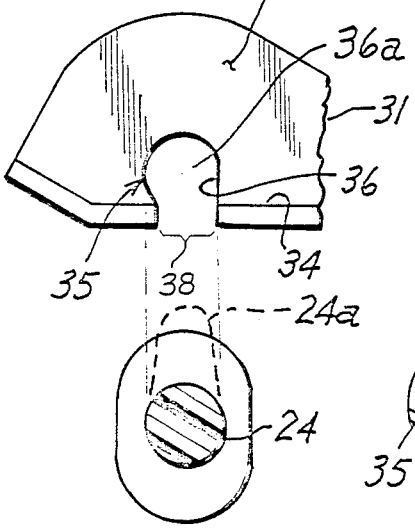
FIG. 3 is an exploded view of part of the invention.

In FIG. 1 there is shown a standpipe assembly 10 incorporating a flush valve 11 according to the invention. The assembly includes a threaded neck 12 that passes though an outlet port in the bottom of a tank where it is held in place by a nut, and connected to the commode (not shown). A tapered gasket 13 closes the outlet port around the neck. A hollow tubular standpipe 14 rises to a maximum water level for the tank, and discharges into an outlet conduit 15 through an internal port 16 below the sealing plane (line 5—5 in FIG. 1) of the flush valve.

The flush valve has a circular seat 20 that surrounds the upper end of the conduit. The edge of its sealing plane is shown in FIG. 1.

Mounting means 21 includes a pair of oppositely directed posts 23, 24 which are cylindrical with a lateral dimension, and a lateral extending ear **23*a*, 24*a*** at their ends.

A flapper 25 includes a flat circular backing plate 26 with a central conical guide 27 on the bottom and a float 28 on the top, both of which may be made of buoyant material. More usually they will form a closed hollow air-filled body. If necessary, weight can be added by a screw **28*a* or other weight means. An annular resiliently-deformable valve seal 29 fits in a groove in the flapper. In its closed position seal 29 bears flat against and conforms to the valve seat in order to close the flush valve. A lift chain 30** is attached to the flapper to lift it to open the valve.

Figure 4:
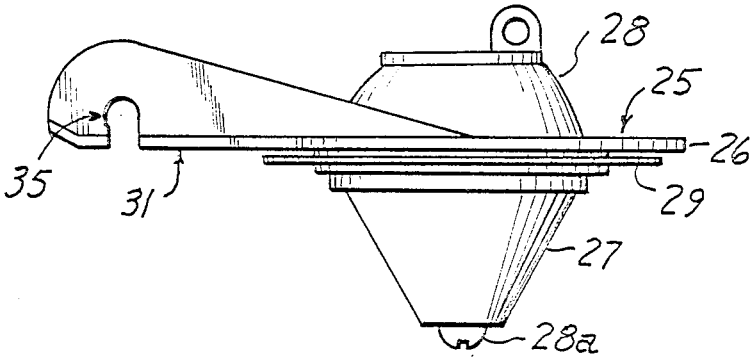
FIG. 4 is a side view of a portion of the flapper of FIG. 1.

In the embodiment illustrated in FIGS. 1 and 4, the valve seal is a flat disc that fits around the guide portion, perhaps in a peripheral groove for a better fluid seal with it. It is preferably adhered to the back-plate by cementing or by being molded in place. Instead of a flat face, it can be shaped for a better fit. It can be made of very resilient material such as a foam, or of a solid elastomer with significant deformability.

Two arms 31, 32 extend parallel to each other away from the valve plate. Each arm has a flat portion 33, and a stiffener flange 34. These arms are quite stiff and are not amenable to being twisted.

Attachment means 35 on each arm comprises a socket 36 open at edge 37, with a slightly narrowed entry clearance 38 that forms a snap-over interference fit with the post. This is to say that its width is slightly less than the diameter of the post, but not so much less that it cannot be sprung open enough to pass the post, and then to spring back to retain the post. Inside this restricted clearance, the socket opens to form a rounded recess 36a that receives the post with enough clearance so the post will act as a pivot pin, and the arm and flapper can easily pivot around it. Then the flapper, while still retained, is readily lifted. Of course the fit should not be too sloppy, because a seal must be made when the valve is closed. Guide 27 on the flapper prevents the flapper from departing excessively from its central arc.

The flapper except for the valve seal can be made of relatively inexpensive hard polyethylene, which is resistant to all presently known water supplies and common additives.

The valve seal must be resilient and chemically resistant. For this purpose a disc of relatively expensive deformable and resilient material EPDM 60 durometer may be used. Its cost precludes its use for the entire flapper, but it is affordable for the small disc needed for the seal. This invention thereby provides an affordable product.

Figure 6:
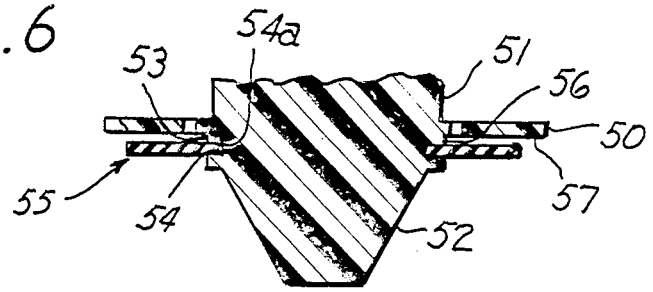
FIG. 6 is a fragmentary axial cross-section of the presently preferred embodiment of seal in its relaxed condition.
Figure 7:
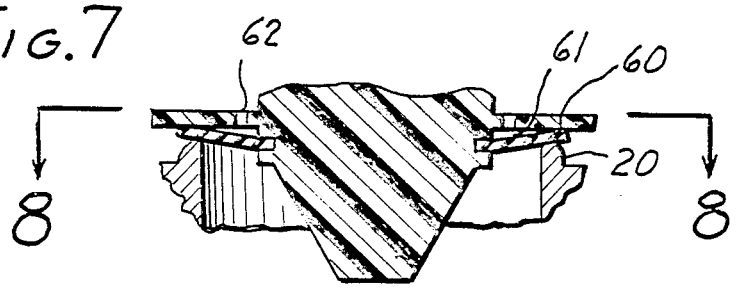
FIG. 7 is a view similar to FIG. 6 showing the seal in its closed condition.
Figure 8:
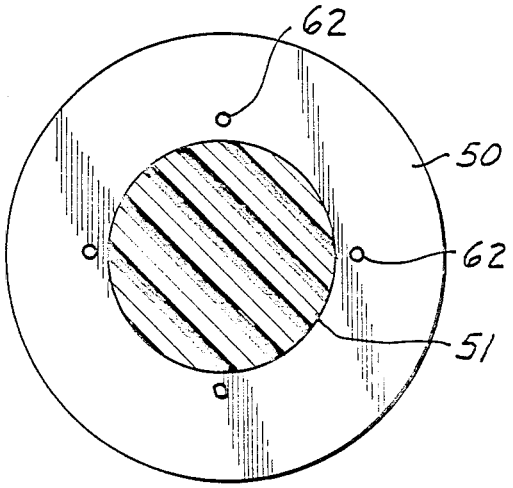
FIG. 8 is a cross-section taken at line 8—8 in FIG. 7.

An even more suitable valve seal can be made, as shown in FIGS. 6–8. This seal can take full advantage of the flexibility of the elastomer, and is more readily manufactured and repaired than the seal of FIGS. 1 and 4.

In FIGS. 6–8, a backing plate 50 with a float portion 51 and a guide portion 52 is shown, which can directly replace these elements in FIG. 1. A central post portion 53 has a peripheral groove 54 to receive the inner circular edge **54*a* of a flat disc-like valve seal 55. The valve seal may simply be snapped into this groove. A spacing segment 56 of the central post spaces the valve seal from surface 57** of the backing plate.

As described, the valve disc is made of a flexible and resilient elastomeric material resistant to the chemicals commonly found in toilet tanks, either from the domestic supply or from additives.

When the valve is open, the relationship between the backing plate and the valve seal is as shown in FIG. 6.

When the valve is closed, the flapper will be held against the valve seat by the pressure of water in the tank, forcing the valve seal against the valve seat. Then a peripheral line seal 60 will be formed with the seat, and the valve will be closed. This has also pressed the outer portion of the valve disc against the backing plate.

Spacing segment 56 at the central post enables the valve disc to flex appropriately to make a good seal. The spacing itself need be no more than about 3/32 of an inch, and it does leave a region 61 which if unvented appears somehow to lead to leakage of the valve.

Accordingly, one or more vent ports 62 are formed in the backing plate so as to enter that region and vent it to the fluid pressure in the tank at the top of the backing plate. This enables entrapped air to leave, and permits equalization of fluid pressures in the tank and in this region. For reasons that are not fully understood, this prevents the valve from leaking as a consequence of valve seal distortion.

The snap-on feature can be used with any seal, and the various seals can be used with any form of flapper attachment. However, when combined, the snap-on feature and the valve seal of FIGS. 6-8 combine to make a relatively inexpensive flapper valve that is resistant to all reasonably anticipated water chemicals and is easy to remove and or replace.

The flapper can be used as original equipment, or as a replacement for a previous flapper. It is only necessary to snap it onto the post, where its interference fit and the ears hold it reliably and releasably in place. If it must be removed, it can as easily be snapped off. Its operation is as described.

This invention is not to be limited by the embodiments shown in the drawings and described in the description, which are given by way of example and not of limitation, but only in accordance with the scope of the appended claims.

I claim:

1. A seal assembly for a valve flapper, said assembly comprising:

a rigid backing disc having a flat backing face and a central post extending from it; and a resilient deformable seal shaped as a flat disc mounted to said post in circumferential sealing contact with said post, said seal having a flat face spaced from the backing face of said backing disc near the post, said backing disc having a vent port therethrough near said central post and opening through said face into the space between the respective faces wherein, with said valve resting on a valve seat said deformable disc will contact said flat backing face along the periphery of said disc and backing face to create a space which is vented by said opening.

2. A seal assembly according to claim 1 in which said post forms a portion of said backing plate, extending therefrom and having a peripheral groove therein to receive the inside edge of a hole through said seal disc.

3. A seal according to claim 1 in which said seal assembly is made of material that is resistant to water supplies and to chemicals characteristically found in toilet tanks.

* * * * *